United States Patent [19]

Harada et al.

[11] 4,204,482

[45] May 27, 1980

[54] COMPARATOR CIRCUIT ADAPTED FOR USE IN A SYSTEM FOR CONTROLLING THE AIR-FUEL RATIO OF AN INTERNAL COMBUSTION ENGINE

[75] Inventors: Toshiro Harada, Okazaki; Tadayuki Kubo, Toyota; Kazusato Kasuya, Kariya; Yukihiro Watanabe, Nagoya, all of Japan

[73] Assignees: Toyota Jidosha Kogyo Kabushiki Kaisha, Toyota; Aisan Industry Co., Ltd., Obu, both of Japan

[21] Appl. No.: 898,987

[22] Filed: Apr. 21, 1978

[30] Foreign Application Priority Data

Feb. 9, 1978 [JP] Japan ..... 53-12940

[51] Int. Cl.[2] ..... F02M 51/00; F02M 7/12

[52] U.S. Cl. ..... 123/32 EE; 123/119 EC

[58] Field of Search ..... 123/32 EE, 119 EC; 60/276, 285

[56] References Cited

U.S. PATENT DOCUMENTS

| | | | |
|---|---|---|---|
| 4,131,089 | 12/1978 | Fujishiro et al. | 123/32 EE |
| 4,132,200 | 1/1979 | Asano et al. | 123/32 EE X |
| 4,140,086 | 2/1979 | Schnorle et al. | 123/32 EE |

*Primary Examiner*—Tony Argenbright

*Attorney, Agent, or Firm*—Stevens, Davis, Miller & Mosher

[57] ABSTRACT

Disclosed herein is a comparator circuit used in a system for controlling, in accordance with an air-fuel ratio signal from an $O_2$ sensor arranged in an exhaust system of an internal combustion engine, the air-fuel ratio of the exhaust gas. The comparator has two inputs, one of which receives a signal having a phase which is the same as a signal from the $O_2$ sensor, the other of which receives a delayed phase signal. The output of the comparator operates to provide, in accordance with the voltage level difference between the inputs, two deviation signals, one of which indicates that air-fuel ratio has deviated to the rich side of the air-fuel ratio the other of which indicates that the air-fuel ratio has deviated to the lean side of the air-fuel ratio.

3 Claims, 8 Drawing Figures

COMPARATOR CIRCUIT ADAPTED FOR USE IN A SYSTEM FOR CONTROLLING THE AIR-FUEL RATIO OF AN INTERNAL COMBUSTION ENGINE

FIELD OF THE INVENTION

The present invention relates to an internal combustion engine provided with a system for controlling the air-fuel ratio in accordance with an electrical signal from a sensor (so-called $O_2$ sensor) arranged in the exhaust system of the engine.

BACKGROUND OF THE INVENTION

In order to operate a so-called three-way catalytic converter arranged in the exhaust system of an internal combustion engine for eliminating the three major toxic component (CO, HC and NOx), the air-fuel ratio of the exhaust gas should be maintained near the theoretical (or stoichiometric) air-fuel ratio value. In order to maintain the theoretical air-fuel ratio, various apparatus have heretofore proposed, in both a carburetor type engine and a fuel injection type engine, for controlling the air-fuel ratio. Generally speaking, each of the known systems is provided with an oxygen concentration cell type sensor (so-called $O_2$ sensor) arranged in the exhaust system of the engine for generation of an electrical signal indicating the air-fuel ratio of the exhaust gas, and with a comparator circuit adapted for providing two deviation signals (generally speaking logic signals "1" and "0"). One of the deviation signals indicates that the air-fuel ratio is decreasing (rich), whereas the other of the deviation signals indicates that air-fuel ratio is increasing (lean). In the carburetor type engine, the deviation signals are utilized for driving an actuator unit, (for example a supplementary fuel injection valve for controlling the amount of additive fuel supplied to the engine intake system or a secondary air valve for controlling the amount of secondary air supplied to the intake or exhaust system of the engine), so that the air-fuel ratio is maintained near the theoretical ratio. When the engine is of the fuel injection type, the deviation signals control the amount of the fuel injected to the intake system of the engine so that the air-fuel ratio is maintained near the theoretical ratio.

In the prior art air-fuel ratio control apparatus, a comparator unit is utilized for obtaining the above mentioned deviation signals, which comparator unit includes a first and a second input. The first input receives a signal from the $O_2$ sensor, the voltage level of which is periodically changed between a maximum level and a minimum level in accordance with the air-fuel ratio. The second input receives a predetermined constant level signal located between the maximum and the minimum levels. Therefore, two logic signals "1" and "0" (or deviation signals) are obtained by comparing the predetermined constant level at the second input with the changed voltage level at the first input. When the voltage level of the air-fuel ratio signal is higher than the predetermined level, one of the deviation signals is obtained. When the voltage level of the air fuel-ratio signal is lower than the predetermined level, the other deviation signal obtained.

However, the prior art comparator circuit suffers from such a drawback that due to a delay inherent in the control system, the air-fuel ratio can not be quickly maintained near the theoretical ratio. As a result, the three-way catalytic converter does not effectively reduce the three major toxic components remaining in the exhaust gas.

SUMMARY OF THE INVENTION

An object of the present invention is to provide a system for controlling the air-fuel ratio of an internal combustion engine, which system is capable of operating without the drawback in the prior arts.

Another object of the present invention is to provide a system for controlling the air-fuel ratio of an internal combustion engine, which system is capable of quickly controlling the air-fuel ratio to the predetermined ratio.

Still another object of the present invention is to provides a comparator circuit of a new construction adapted for use in an air-fuel ratio control system.

According to the present invention there is provided an apparatus for operating a system for controlling, in accordance with an electrical signal from air fuel-fuel ratio sensor arranged in an exhaust system of an internal combustion engine, the air-fuel ratio of the exhaust gas in the exhaust system. Said apparatus comprises:

comparator means which includes a first and a second input, said first input being associated with the air-fuel ratio sensor so that an electrical signal of the same phase as the signal generated by the sensor is received by the first input, said second input being associated with the sensing means so that an electrical signal of delayed phase is received by the second input;

means for causing an amplitude of the above mentioned same phase signal to be varied with respect to the delay phase signal, and;

an output adapted for providing in response to the difference of voltage levels between the first and the second input, two deviation signals;

one of which allows said system to operate to increase the air-fuel ratio of the exhaust gas and the other of which allows the system to operate to decrease the air-fuel ratio.

One of the deviation signal indicates that the air-fuel ratio is increasing whereas the other of deviation signal indicates that the air-fuel ratio is decreasing. An actuator unit driven by the deviation signals can quickly control the air-fuel ratio so that it is maintained near the predetermined ratio, for example theoretical ratio. Since the amplitudes of the same phase signal and the delay phase signal are different, the comparator unit does not fluctuate even if the air-fuel ratio signal includes a small fluctuation in the output voltage level.

DETAILED DESCRIPTION OF THE PREFERRED EMBODIMENTS

Figure 1:
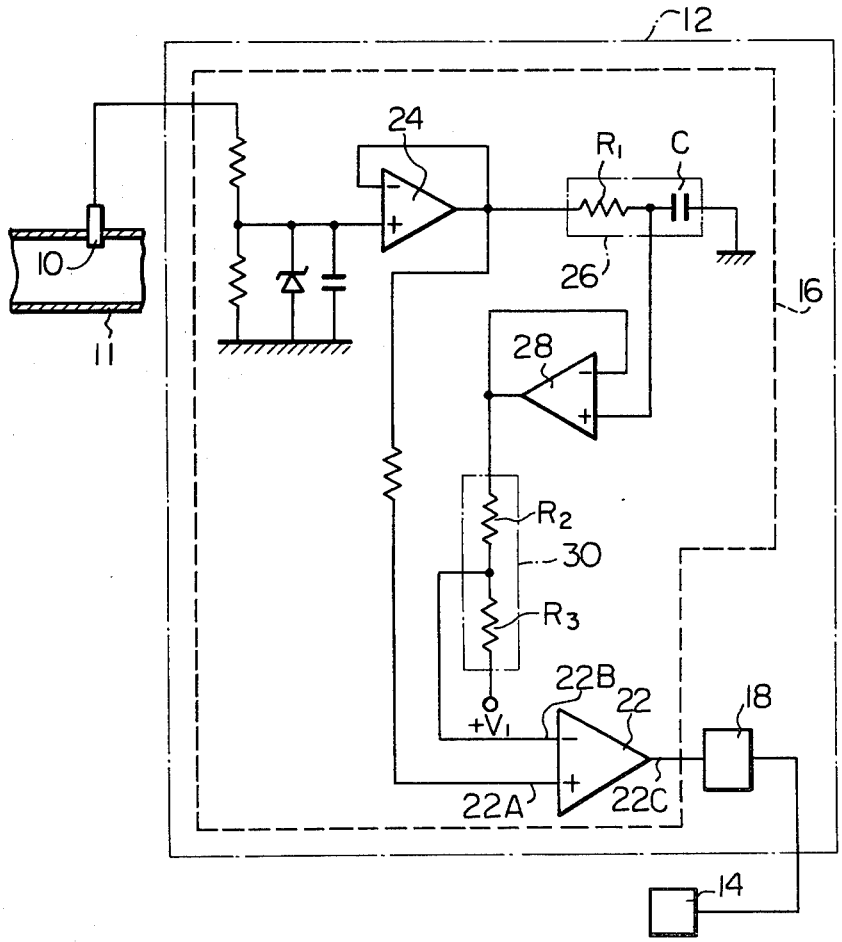
FIG. 1 illustrates an apparatus for controlling the air-fuel ratio including a comparator circuit according to the present invention.
Figure 2:
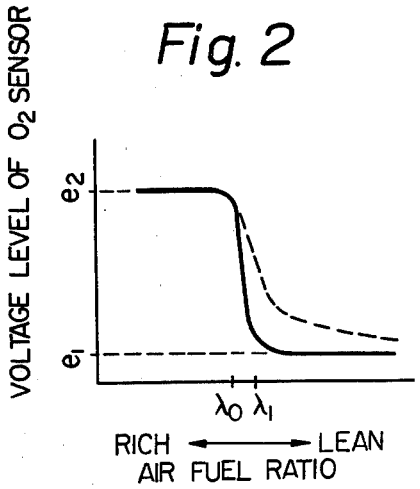
FIG. 2 illustrates the relation between the air-fuel ratio and the output voltage level of an $O_2$ sensor.

In FIG. 1 in which a first embodiment of the present invention is illustrated, the reference numeral 10 designates a so-called $O_2$ sensor mounted on an exhaust pipe 11 of an internal combustion engine. The $O_2$ sensor 10 is essentially an oxygen concentration cell which provides an electrical signal with a voltage level which is changed from low level ($e_1$ V) to high level ($e_2$ V) at a predetermined theoretical (or stoichiometric) air-fuel ratio $\lambda_0$ as indicated in FIG. 2. In FIG. 1, the reference numeral 12 designates an air-fuel ratio control apparatus according to the present invention, including a comparator circuit 16 which is adapted for providing two logic signals in accordance with the electrical signal from the $O_2$ sensor 10, as will be fully described later. Connected to the comparator circuit 16, via an air-fuel ratio control circuit 18, is an actuator unit 14 which receives said logic signals for controlling the air-fuel ratio of the exhaust gas in the exhaust pipe 11 of the engine. When the engine is provided with an air injection system having a vacuum operated flow control valve adapted for controlling the amount of secondary air introduced into the exhaust pipe of the engine, the actuator unit 14 may be an electro-magnetic valve which selectively transmits a vacuum signal from an intake system of the engine into the vacuum operated flow control valve. The air-fuel ratio control circuit 18 may be an amplifier unit. When the engine is provided with a supplementary fuel injection system for injecting an amount of fuel into the intake pipe of the engine, which is itself known, the actuator unit 14 may be a supplementary fuel injection valve adapted for increasing or decreasing the amount of injected fuel in accordance with a lean or rich logic signal from the apparatus 12.

Figure 3:
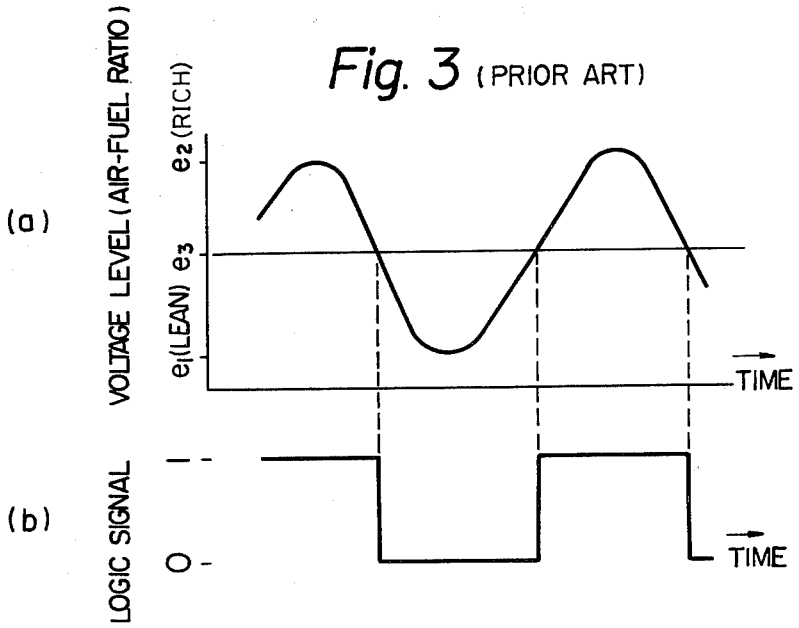
Fig. 3 (PRIOR ART)
FIG. 3 consists of graphs indicating the operation of the prior art comparator circuit.

As is well known to those skilled in this art, an output voltage level of the signal from the $O_2$ sensor 10 is periodically changed between the low level $e_1$ and the high level $e_2$ because of the delay time in the air-fuel control system. In the prior art, in order to obtain the logic signals for operating the actuator unit 14, a comparator having an input of a predetermined fixed reference voltage level, for example, $e_3$ (FIG. 3) which voltage level $e_3$ exists between the levels $e_1$ and $e_2$. The comparator also has another input adapted for receiving the signal from the $O_2$ sensor 10. Therefore, the prior art comparator provides a first logic signal (in the embodiment a logic signal of "1") indicating a rich air-fuel ratio, and provides a second logic signal (a logic signal "0" in the embodiment) indicating a lean air-fuel ratio. These logic signals are supplied to the actuator unit. Thus, a quick increase or decrease of the air-fuel ratio to the predetermined ratio $\lambda_0$ was impossible in the prior art.

According to the present invention, in order to effect a quick control of the air-fuel ratio, an air-fuel ratio controlling apparatus including a comparator circuit 16 (FIG. 1) is used. The comparator circuit 16, adapted for providing a rich or a lean logic signal whether the air-fuel ratio is increasing or decreasing is essentially comprised of a comparator unit 22, a buffer amplifier 24, a delay unit 26, a buffer amplifier 28 and a potentiometer 30. The comparator unit 22 has a first input 22A and a second input 22B. The first input 22A receives a signal from the $O_2$ sensor 10 by way of the buffer amplifier 24. The second input 22B of the comparator unit 22 receives a signal from the $O_2$ sensor 10 by way of the buffer amplifier 24, the delay unit 26, comprised of a resistor R1 and a capacitor C, the buffer amplifier 28 and the potentiometer 30, comprised of two resistors R2 and R3. The comparator unit 22 also has an output 22C which is connected to the air-fuel ratio control circuit 18.

The operation of the control comparator circuit 16 will now be described. The $O_2$ sensor 10 provides, in accordance with the air-fuel ratio of the exhaust gas in the exhaust pipe 11, an electrical signal, the voltage level of which is periodically changed in accordance with the lapse of time as shown by a solid line A in FIG. 4(*a*). The buffer amplifier 24 provides, at the output side thereof, a signal of the same phase as the signal A, which same phase signal is received by the first input 22A of the comparator unit 22. The second input 22B of the comparator 22 receives, from the buffer amplifier 24, a signal B (FIG. 4), the phase of which is, with respect to the signal A, delayed for a predetermined period because of the existence of the delay unit 26 arranged between the buffer amplifiers 24 and 28. The amplitude of the delayed phase signal B, received by the second input 22B of the comparator unit 22, is controlled by the potentiometer 30 so that it is smaller than the amplitude of the same phase signal A. The reason for this will be described hereinafter.

Figure 4:
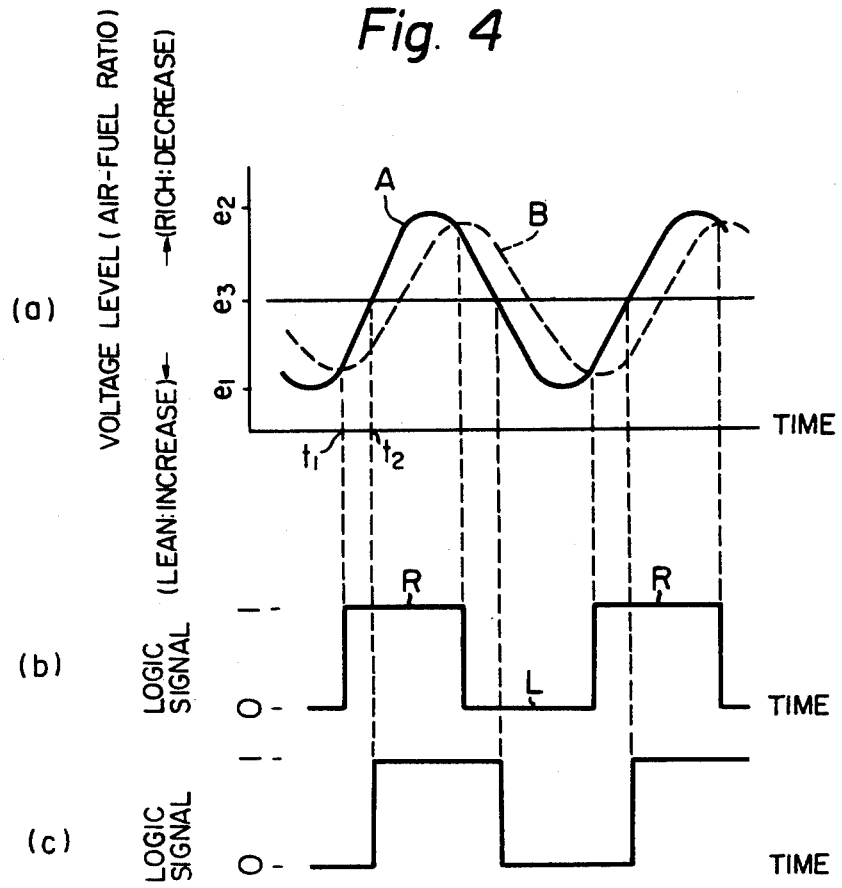
FIG. 4 consists of graphs illustrating the operation of the present invention.

Since the first input 22A receives the signal A of same phase as that of the signal generated by the $O_2$ sensor 10, while the second input 22B receives the signal B of delayed phase, the output 22C provides a logic signal "1" when the level of A is larger than that of B and provides a logic signal "0" when the level of A is smaller than that of B, as shown in FIGS. 4(*a*) and (*b*). The same phase signal A indicates the air-fuel ratio of the exhaust gas at a time, while the delay phase signal B indicates the air-fuel ratio of the exhaust gas at an earlier time. Thus, the fact that the voltage level of the same phase signal A is larger than that of delayed phase signal B indicates that the air-fuel ratio is decreasing. Whereas, the fact that the voltage level of the same phase signal A is smaller than that of the delayed phase signal B indicates that the air-fuel ratio is increasing. In other words, the logic signal "1" means a rich deviation signal, which indicates that air fuel ratio is decreasing, whereas the logic signal "0" means a lean deviation signal which indicate that air-fuel ratio is increasing.

The thus obtained logic signal "1" or "0" (deviation signal) is transmitted, via the air-fuel ratio control circuit 18 (FIG. 1), to the actuator unit 14. Since the actuator unit 14 is itself well known to those skilled in this art, the detailed construction and operation of the unit 14 is not explained herein. When said rich deviation signal (logic signal "1") is received by the actuator unit 14, the unit 14 permits the air-fuel ratio to become lean (or increase). When said lean deviation signal (logic signal "0") is received by the actuator unit 14, the unit 14 permits the air-fuel ratio to become rich (decrease). It should be noted that, in the prior art, since the comparator unit compares the voltage level of the signal A from the $O_2$ sensor with a predetermined level $e_3$ (FIG. 4(*a*)), a rich or lean deviation signal "1" or "0" is obtained as shown in FIG. 4(*c*). As is clear from FIGS. 4(*a*), (*b*) and (c), in the present invention a deviation signal is issued at a time $t_1$. In the prior art a deviation signal is issued at a later time $t_2$. Therefore, the present invention makes it possible to quickly generate the rich or lean deviation signals. Thus, the air-fuel ratio is effectively controlled so that it remains near the predetermined value for example, a theoretical value.

Figure 5:
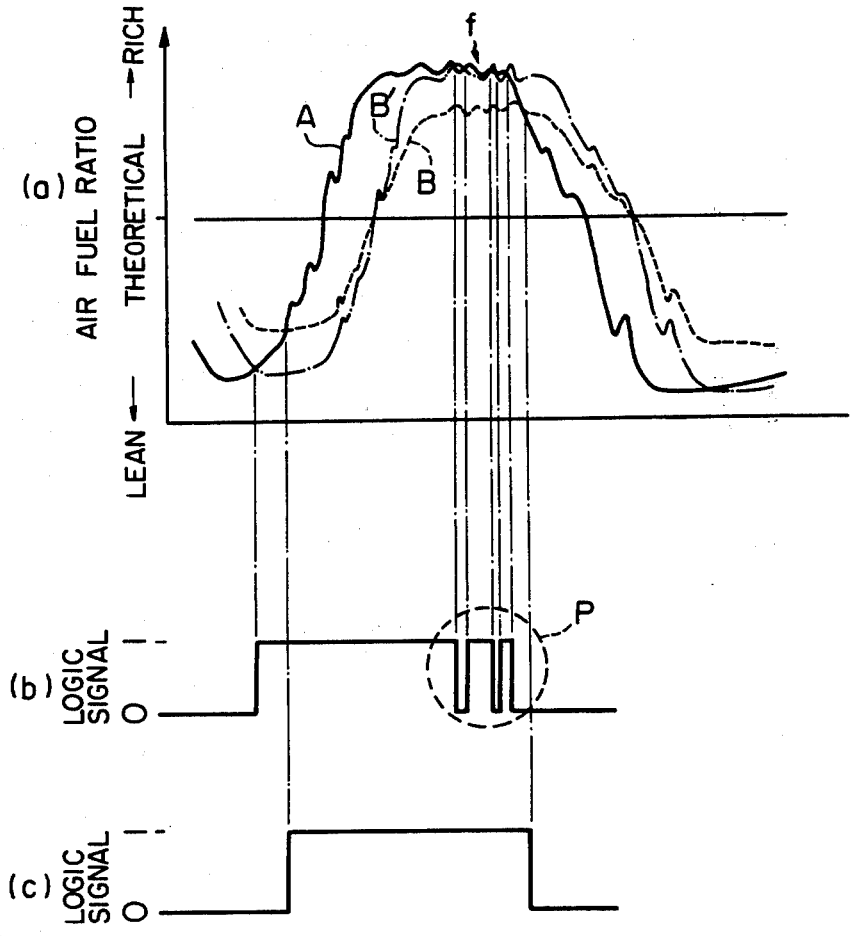
FIG. 5 consists of graphs illustrating the operation of the present invention when the output voltage level of the $O_2$ sensor has a small fluctuation.

According to the present invention, the potentiometer 30 (FIG. 1) permits the amplitude of the delayed phase signal B to be slightly smaller than the amlitude of the same phase signal A, since the voltage level applied to the resistor $R_3$ of the potentiometer from an electrical source $+V_1$ is so determined that it is between the voltage level $e_1$ and $e_2$. If potentiometer 30 is not used, the same phase signal and the delayed phase signal have, as shown by A and B' in FIG. 5, the same amplitude. This would cause the comparator unit 22 to accidentally operate, as shown by P in FIG. 5(*b*), when the electrical signal from the $O_2$ sensor includes a small fluctuation in the voltage level thereof as shown by f. Since the amplitude of delayed phase signal supplied to the comparator unit 22 is, as shown by B in FIG. 5(*a*), slightly decreased when compared with the amplitude of the same phase signal A according to the present invention, the comparator unit 22 does not accidentally operate as shown by FIG. 5(*c*).

By producing the differences in amplitude between the same phase signal A and the delayed phase signal B, it is also possible to maintain the air-fuel ratio near the predetermined ratio, for example theoretical ratio, when the air-fuel ratio in changed at a rich side or lean side. When the air-fuel ratio sensed by the $O_2$ sensor 10 is periodically changed in a region where the air-fuel ratio is rich, as shown by $A_1$ in FIG. 6(*a*), the potentiometer 30 controls the amplitude of the delayed phase signal $B_1$ so that it is smaller than the amplitude of the same phase signal $A_1$. Thus, the comparator unit 22 provides, in accordance with the voltage level difference between the signal $A_1$ and $B_1$, a rich deviation (logic) signal "1" or a lean deviation (logic) signal "0", as shown in FIG. 5(*c*). The duty ratio of the rich signal "1" is higher than that of lean signal "1", as shown by the curve of FIG. 5(*c*), and therefore, the rich air-fuel ratio is increased to the predetermined air-fuel ratio.

Figure 6:
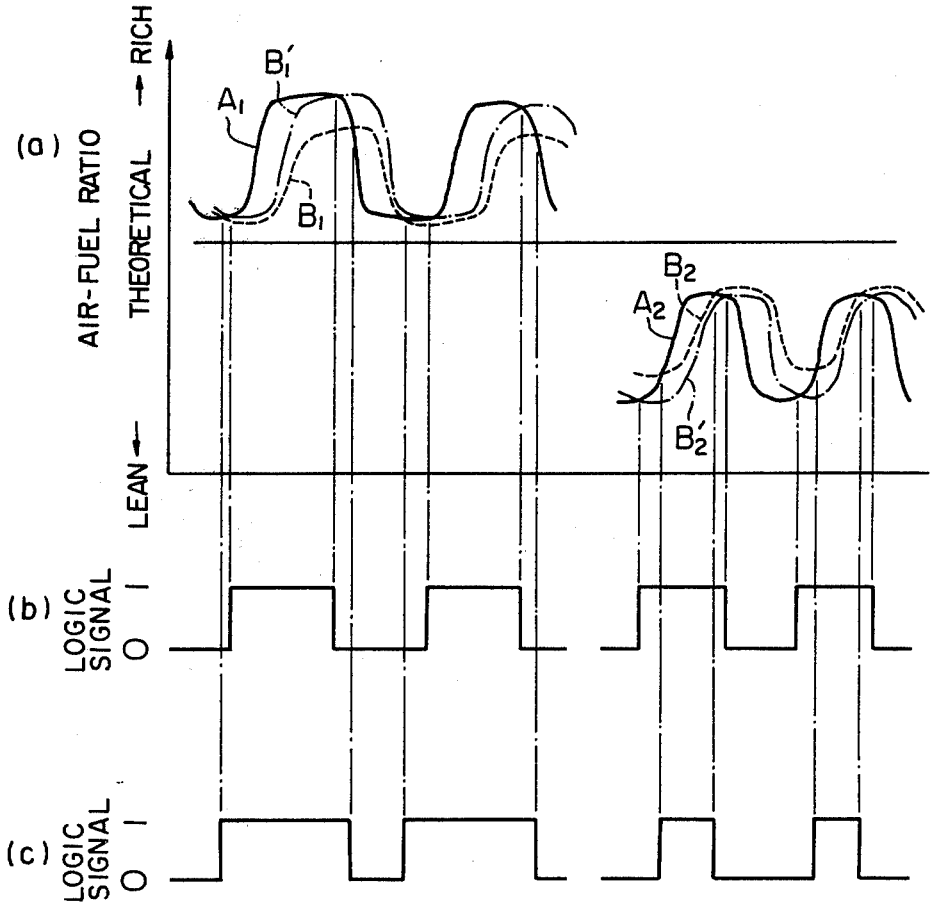
FIG. 6 consists of graphs illustrating the operation of the present invention when the output signal level of the $O_2$ sensor is changed in a rich side of air-fuel ratio or a lean side of air-fuel ratio.

When the air-fuel ratio is changed in a region where the air-fuel ratio is lean, an shown by $A_2$ of FIG. 6(*a*), the potentiometer 30 restricts the amplitude of the delayed phase signal $B_2$ so that it is smaller than the amplitude of the same phase signal $A_2$. Thus, the comparator unit 22 in FIG. 1 provides, in accordance with the voltage level difference of the same phase signal $A_2$ and the delayed phase signal $B_2$, a rich deviation signal "1" or a lean deviation signal "0", as shown in FIG. 6(*c*). The duty ratio of the lean deviation signal "0" is higher than that of the rich deviation signal "1". Therefore, the lean air-fuel ratio is decreased to the predetermined air fuel ratio.

It should be noted that, if the delayed phase signal has, as shown by $B_1'$ or $B_2'$ in FIG. 6(*a*), the same amplitude as that of the same phase signal $A_1$ or $A_2$, the duty ratio of the rich signal "1" and the lean signal "0" in both cases is equal to the same value, as shown in FIG. 6(*b*), and therefore, the control of the air-fuel ratio to the predetermined value is impossible.

Figure 7:
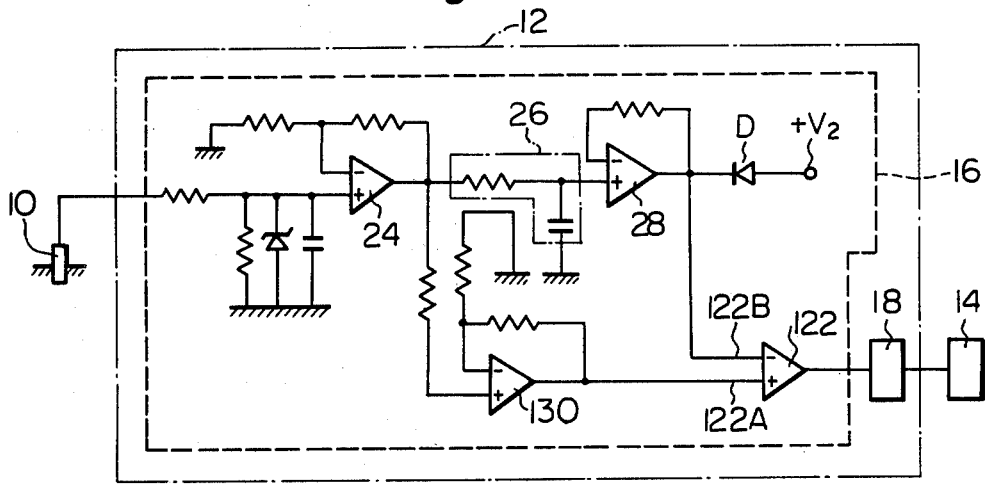
FIG. 7 illustrates a second embodiment of the present invention.

A second embodiment of the present invention, shown in FIG. 7, differs from the first embodiment of FIG. 1 in that it includes, in place of the potentiometer 30 of FIG. 1, an amplifier unit 130 which is located between the buffer amplifier 24 and a first input 122A of the comparator unit 122, and; in that a second input 122B of the comparator unit 122 connected to the buffer amplifier 28 is connected via a diode D to a electrical source $+V_2$ of a predetermined voltage level.

In the operation of the second embodiment, since the input 122A is connected to the amplifier 130, the amplitude of the same phase signal A at this input 122A is larger than the amplitude of the delayed phase signal B at the second input 122B. Therefore, the effects of the present invention as described with reference to FIGS. 5 and 6 are obtained with this second embodiment also.

Figure 8:
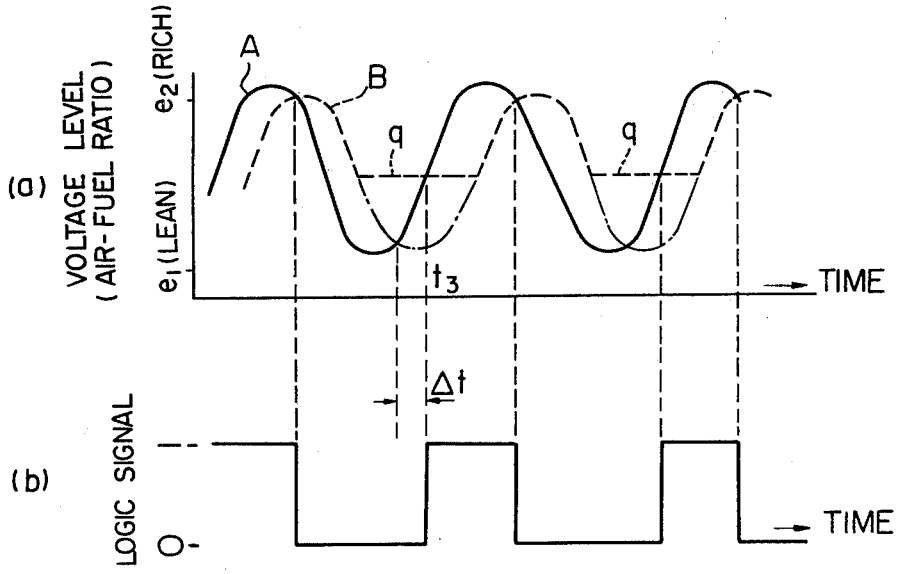
FIG. 8 consists of graphs illustrating the operation of the apparatus in FIG. 7.

As is well known to those skilled in this art, the output characteristics of the $O_2$ sensor 10 is changed as shown by a dotted line in FIG. 2 after prolonged use of the sensor 10, so that the $O_2$ sensor 10 detects an air-fuel ratio $\lambda_1$ which is higher (lean) than the theoretical air-fuel ratio $\lambda_0$. In order to effectively control the air-fuel ratio by the $O_2$ sensor 10, the voltage level of the source $+V_2$ connected to the input 122B via the diode D is selected so that it is between the levels $e_1$ and $e_2$. Therefore, the voltage level at the input 122B of the comparator unit 122 is compensated so that it is higher than the predetermined level, q, even if the $O_2$ sensor detects a lean air-fuel ratio. Thus, a time $t_3$, when the rich deviation signal is generated is delayed for a time $\Delta t$, as shown in FIG. 8. During the time $\Delta t$ the comparator unit 122 provides a lean signal and the air-fuel ratio is descreased to the rich side. Thus, the air-fuel ratio can operate to effectively maintain the air-fuel ratio near the theoretical air-fuel ratio, even if the $O_2$ sensor detects the air fuel ratio $\lambda_1$ (FIG. 2), which is larger (leaner) than the theoretical air-fuel ratio $\lambda_0$.

While this invention is described with reference to particular embodiments, many modifications and changes can be made by those skilled in this art without departing from the scope of this invention.

What is claimed is:

1. A method of producing, in an internal combustion engine provided with an exhaust line, logic signals "0" and "1", one of which indicates a small air-fuel ratio of the exhaust gas and the other indicates a large air-fuel ratio of the exhaust gas, said logic signals being utilized for operating an air-fuel ratio control system of the engine, said method comprising the steps of:

generating, by utilizing an air-fuel ratio sensor attached to the exhaust line, a first analogous electrical signal, the voltage level of which is periodically changed in accordance with the air-fuel ratio of the exhaust gas;

generating, by utilizing a phase control unit receiving the first analogous signal, a second analogous electrical signal, the second analogous signal having a delayed phase when compared with the phase of the first analogous signal;

comparing the voltage level of the first analogous signal with that of the second analogous electrical signal for generating one of the logic signals when the voltage level of the first analogous signal is higher than that of the second analogous signal and for generating the other logic signal when the voltage level of the first analogous signal is lower than that of the second analogous signal; and introducing the logic signals into the air-fuel ratio control system, one of the logic signals being adapted for increasing the air-fuel ratio, the other logic signal being adapted for decreasing the air-fuel ratio.

2. A method according to claim 1, further comprising the step of varying the amplitude of one of the first and second analogous signals.

3. A method according to claim 1, further comprising the step of maintaining the voltage level of one of the two analogous signals so that it is always higher than a predetermined level located between a maximum and a minimum level of the signal of the analogous signal.

* * * * *